United States Patent [19]

Watanabe et al.

[11] Patent Number: 4,620,102

[45] Date of Patent: Oct. 28, 1986

[54] ELECTRON-IMPACT TYPE OF ION SOURCE WITH DOUBLE GRID ANODE

[75] Inventors: Fumio Watanabe, Fukushima; Yoshiaki Hara, Tokyo; Masao Miyamoto, Tokyo; Yasuo Kusumoto, Tokyo; Syojiro Komaki, Tokyo, all of Japan

[73] Assignee: Seiko Instruments & Electronics Ltd., Tokyo, Japan

[21] Appl. No.: 715,498

[22] Filed: Mar. 25, 1985

[30] Foreign Application Priority Data

Mar. 26, 1984 [JP] Japan ..... 59-58030

[51] Int. Cl.[4] ..... H01J 27/20

[52] U.S. Cl. ..... 250/427; 250/288; 313/360.1; 313/363.1

[58] Field of Search ..... 250/427, 423, 424, 288; 313/360.1, 363.1

[56] References Cited

U.S. PATENT DOCUMENTS 4,272,699 6/1981 Faubel et al. ..... 313/360.1

OTHER PUBLICATIONS

Pittaway, Philips Research Reports, v. 29, 1974, pp. 363–382.

*Primary Examiner*—Bruce C. Anderson
*Assistant Examiner*—Jack I. Berman
*Attorney, Agent, or Firm*—Robert E. Burns; Emmanuel J. Lobato; Bruce L. Adams

[57] ABSTRACT

A double grid anode is characterized in that said anode is comprised of a first cage-like anode made of a metal grid or wire gauze that permits that passage of electrons and that has an open end, a second anode which also consists of a metal grid or wire gauze located at the open end side of said first anode, a hot-cathode filament arranged around the outer periphery of said first anode, and an ion-extraction electrode which faces said anode.

2 Claims, 20 Drawing Figures

ELECTRON-IMPACT TYPE OF ION SOURCE WITH DOUBLE GRID ANODE

BACKGROUND OF THE INVENTION

The present invention relates to an ion source of a residual gas analyzer which can be used in ultrahigh vacuum regions, and more specifically to an ultrasensitive ion source of the hot-cathode electron impact type, which is small in size, which enables the easy removal of gases, and which permits only a very small energy dispersion in the obtained ionic current.

Hot-cathode electron-impact ion sources are often used in mass analyzers, etc., because of their high sensitivity and high stability. In recent years, vacuum techniques have developed rapidly, and ultrahigh vacuum conditions of $10^{-6}$ Pa ($\simeq 10^{-8}$ Torr) can be obtained easily. In this vacuum region, the quality of the vacuum, i.e., the analysis of residual gases, is of importance. Therefore, a mass analyzer which can employ a hot-cathode electron-impact type of ion source plays an important role as a residual gas analyzer. To explain this in more detail, the gases remaining in an ultrahigh vacuum have mass numbers smaller than that of carbon dioxide, which is 44. Therefore, a mass analyzer capable of measuring mass numbers of between 50 to 100 will suffice for this purpose. A quadruple electrode type of mass analyzer is often used, but it does not enable any reduction in resolution, although it does allow some dispersion of the energy of the generated ions.

When such a device is to be used under ultrahigh vacuum conditions of less than 10−8 Torr, however, the gases emitted from the ion source impede the correct analysis of the residual gases. To analyze residual gases in the ultrahigh vacuum region, therefore, a quadruple electrode type of mass analyzer provided with a BA gauge type of electrode-impact ion source with a cage-like grid anode is chiefly used, since it has a relatively high sensitivity and permits the easy removal of gases. Even with this BA gauge ion source with its high sensitivity and easy gas removal, however, its sensitivity is about $3\times10^{-4}$ A/Torr at the most with an electron current of between 2 to 5 mA. Under ultrahigh vacuum conditions of less than $10^{-8}$ Torr, therefore, the obtained ionic current is at most: ($\simeq 3\times10^{-4}$ A/Torr)$\times$($10^{-8}$ Torr)$=\simeq 3\times10^{-12}$ A. Therefore, even if an attempt is made to analyze residual gases with a resolution of about 10%, the current obtained is less than $\simeq 3\times10^{-13}$ A, and dc amplification alone is not sufficient for analyzing residual gases under vacuum conditions of less than $10^{-8}$ Torr. In order to analyze residual gases under vacuum conditions of less than $10^{-8}$ Torr, therefore, it has been proposed to amplify the ionic current by between $10^5$ to $10^6$ using a secondary electron multiplier device. However, not only is a gas analyzer equipped with a currently-available secondary electron multiplier device relatively large in size and expensive, the secondary electron multiplier device is prone to large changes with time, so that the analyzer has a poor reliability, and requires a cumbersome handling operation.

These problems result from the fact that even with a BA gauge highly-sensitive ion source, the utilization efficiency of the generated ions is as low as about 1/100 to 1/10. This stems from a defect of the BA gauge type of ion source in that the energy of the ions generated in the cage-like grid anode is dispersed to a large extent ($\approx$50 eV). Even with a quadruple-electrode mass analyzer that allows some degree of energy dispersion, the incident energy of the ions must be suppressed to less than about 10 eV when the length of the poles of quadruple electrodes is less than 10 cm, so that the ions generated by the ion source are not all utilized. The construction and function of a BA gauge type of ion source will be described below with reference to a conventional example that is shown in the drawings. FIG. 1 is a section through a BA gauge type of ion source. Thermoelectrons emitted from a hot-cathode filament 1 are attracted by a cylindrical cage-like anode 2, travel through the cage, are reflected by a repeller electrode 3 on the opposite side, are attracted again by the cage-like anode 2, and travel through the cage repeatedly, to ionize the gas molecules.

The vibrating electrons are eventually captured by the cage-like anode 2. However, the electric current flowing through the hot-cathode filament 1 is controlled by an electronic circuit so that the electronic current obtained through the cage-like anode 2 is always constant. Thus large quantities of cations are generated around the cage-like anode 2. However, the ions generated within the cage-like anode 2 are attracted by the negative electric field of an ion-extraction electrode 4 that is inserted into the cage-like anode 2 through an ion-extraction port formed in the anode 2, so that the ions are emitted from the cage-like anode 2 through the ion-extraction port. The electrons vibrate within the cage-like anode 2, not only in the lateral directions, but also in the vertical direction, so that large quantities of ions are generated even at the portion of ion-extraction port where the potential of the introduced electric field is low. The ions generated on the surface of the anode are far from the ion-extraction port, and are less attracted thereby, but the ions generated in the low-potential region near the ion-extraction port are drawn thereby very efficiently. Therefore, the energy of the ions obtained through the ion-extraction electrode 4 is very dispersed, and is uniformly distributed along the potential gradient of the cage-like anode 2 and the ion-extraction electrode 4. The potential difference between the two electrodes is at least about 80 volts (when the maximum energy of the electrons is 60 eV), and the energy dispersion of the obtained ions is about 50 eV. In a quadruple-electrode mass analyzer, ions of a large energy dispersion that have passed through the ion-extraction electrode 4 must be decelerated to less than 10 eV before reaching an analyzer portion 5. Therefore, the efficiency with which the ionic current is utilized is low. For instance, when the incident ions have an average energy of 10 eV, the energy dispersion is distributed over the whole range between 0 to 20 eV, so that ions of an energy greater than 10 eV pass through the analyzer portion 5 without any mass analysis, reducing the resolution. When ions have a large energy dispersion, it is difficult to converge an ion beam with an electrostatic lens system, and the sensitivity is reduced.

OBJECT OF THE INVENTION

The present invention was accomplished in view of these circumstances, and its object is to provide an ultra-sensitive electron-impact type of ion source in which a cage-like anode has a double construction, ions formed between these two anodes are efficiently converged to increase sensitivity, the potential difference between the two anodes is suppressed to a few volts to minimize the energy dispersion of the generated ions and increase the mass-analysis resolution, so that residual gases can be analyzed under vacuum conditions of less than $10^{-8}$ Torr, without a secondary electron multiplier device.

DETAILED DESCRIPTION OF PREFERRED EMBODIMENTS OF THE INVENTION

Figure 1:
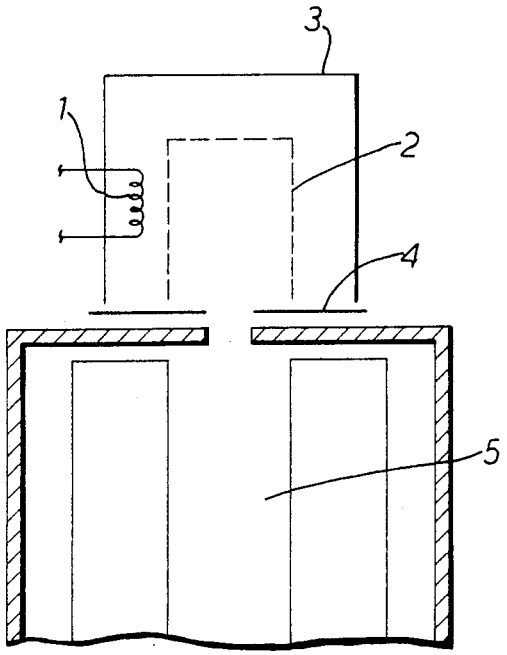
FIG. 1 is a section through a conventional BA gauge type of ion source and an analyzer portion.

The present invention will be described below in detail with reference to an embodiment shown in the drawings.

Figure 2:
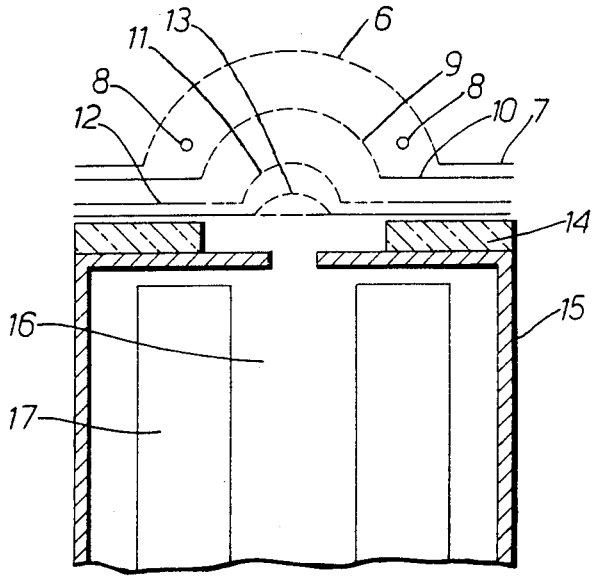
FIG. 2 is a section through an electron-impact type of ion source with double grid-anodes and an analyzer portion according to an embodiment of the present invention.
Figure 3A:
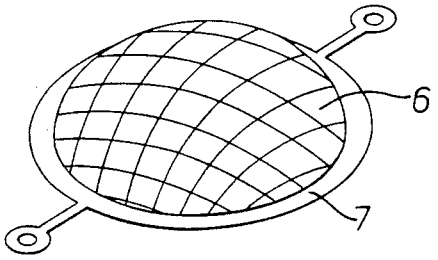
FIG. 3 is perspective views of the constituent parts of FIG. 2.
Figure 3B:
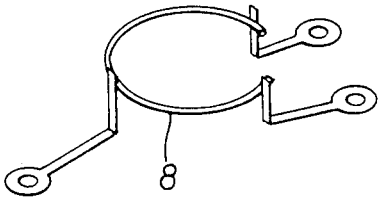
Figure 3C:
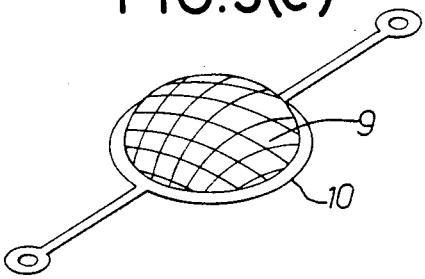
Figure 3D:
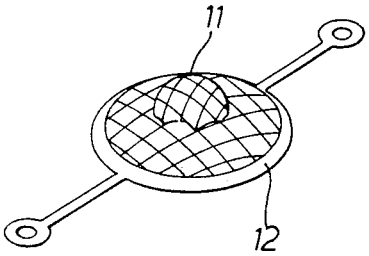
Figure 3E:
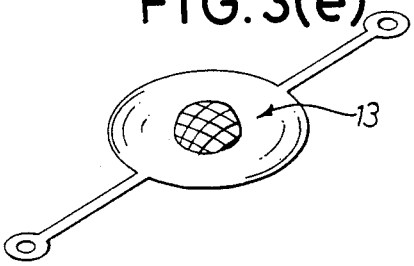
Figure 3F:
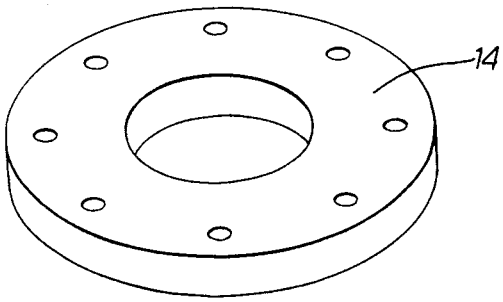
Figure 4A:
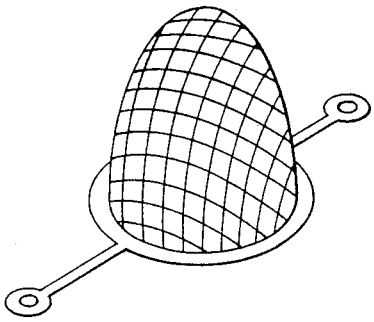
FIGS. 4, 5 and 6 are perspective views of the first anodes, the second anodes, and the ion-extraction electrodes according to other embodiments of the present invention.
Figure 4B:
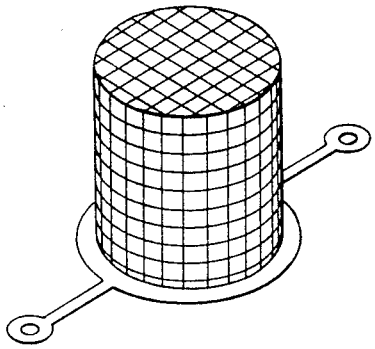
Figure 5A:
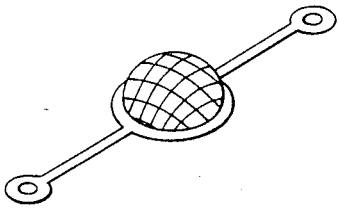
Figure 5C:
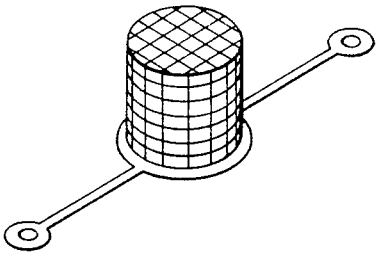
Figure 5B:
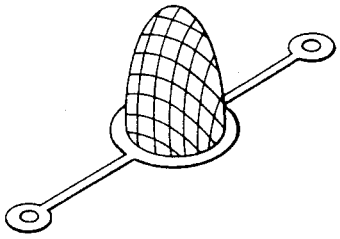
Figure 5D:
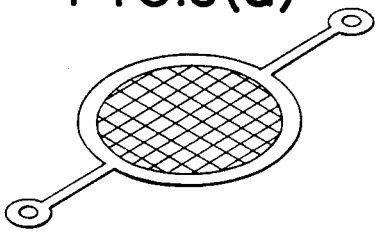

FIG. 2 is a diagram of the construction of an electron-impact ion source according to an embodiment of the present invention. A first anode 9 is obtained by pressing 30 mesh molybdenum gauze of a wire diameter of 0.05 mm into a hemispherical shape with a diameter of 14 mm, and welding a molybdenum ring 10 thereto to prevent the mesh spreading. The approximately hemispherical first anode is positioned with its open end downward. The first anode 9 need not be limited to this approximately hemispherical shape alone, it can have any of a variety of shapes such as that obtained by cutting a rotary ellipsoid in half [(FIG. 4(*a*)], that obtained by covering one side of a cylindrical grid with wire gauze or a grid [(FIG. 4(*b*)], provided that it has a cage-like construction through which electrons can pass, and it has an open end on one side.

A second anode 11 is a 14 mm electrode made of the same molybdenum gauze as the first anode 9 which has an approximately hemispherical protuberance of a diameter of about 8 mm matching the shape of the first anode 9, and to which a molybdenum ring 12 is welded to prevent the mesh spreading. The shape of the second anode 11 made of wire gauze need not be limited to an approximately hemispherical protuberance alone, but can consist of an approximately hemispherical portion along [FIG. 5(*a*)], or it can have a shape obtained by cutting a rotary ellipsoid into a half [FIG. 5(*b*)], or that obtained by closing one side of a cylindrical grid with wire gauze or a grid [FIG. 5(*c*)], or it can be obtained by simply stretching a plain-woven wire gauze [FIG. 5(*d*)]. That is, the second anode 11 can have any shape provided that it enables the formation space between it and the first anode 9 for the generation of ions.

Figure 6A:
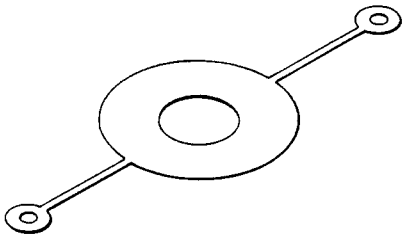
Figure 6B:
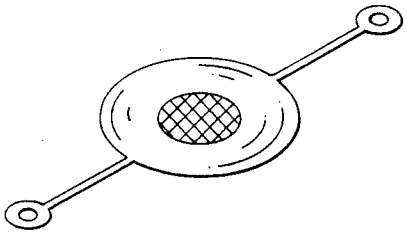
Figure 6C:
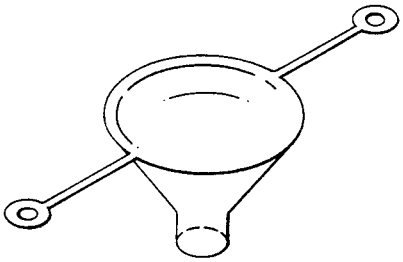

An ion-extraction electrode 13 is obtained by forming a hole about 6 mm in diameter at the center of a molybdenum disc which is 15 mm in diameter, and attaching to the hole a double layer of 50 mesh tungsten gauze of a wire diameter of 0.03 mm, shaped like a convex lens. The protuberance in the tungsten gauze is about 1.5 mm high, and the lining wire gauze is composed of plain-woven wire gauze which is stretched flat. In this case as well, the electrode should in no way be limited to the shape shown along, it can have the shape of a doughnut plate without any wire gauze [FIG. 6(*a*)], or it can be made of simple plain-woven wire gauze [FIG. 6(*b*)], or it can have a funnel shape flaring upward [FIG. 6(*c*)], provided that it has a hole in its central portion to guide the ions downward.

A hot-cathode filament 8 is an annular filament made of an oxide obtained by electrodepositing thorium oxide powder onto a rhenium wire of a diameter of 0.15 mm, followed by sintering. The hot-cathode filament 8 is arranged around the outer periphery of the spherical portion of the first anode 9.

A shielding electrode 6 prevents the electrons emitted from the hot-cathode filament 8, and which are vibrating between the inside and outside of the first anode 9, from flying out of the ion source. The shielding electrode 6 is obtained by pressing 20 mesh molybdenum gauze of a wire diameter of 0.1 mm into an approximately hemispherical shape, and welding a molybdenum ring 7 thereto to prevent the mesh spreading. The shielding electrode 6 need not be limited to a hemispherical shape alone, it can have any shape provided it is capable of shielding the electrons.

Reference numeral 14 denotes an insulating plate made of a ceramic material. The shielding electrode 6, hot-cathode filament 8, first anode 9, second anode 11, and ion-extraction electrode 13 are mounted on the insulating plate 14 by stainless steel screws of a diameter of 2 mm.

Reference numeral 15 denotes an outer cylinder of an analyzer portion 16, which has an ion-incident hole of a diameter of 3.5 mm at the central portion thereof, and 17 denotes analyzer rods of a quadruple-electrode mass analyzer, each of the rods being 6 mm in diameter and 50 mm long.

The distances between the shielding electrode 6 and the first anode 9, the first anode 9 and the second anode 11, and between the second anode 11 and the ion-extraction electrode 13 are each about 1 mm, the distance between the ion-extraction electrode 13 and the outer cylinder 15 of the analyzer portion is about 3 mm, and the distance between the hot-cathode filament 8 and the first anode 9 is about 3 mm.

The diagrams of FIG. 3 are perspective views of the electrodes and insulating plates of FIG. 2. The function of the thus-constructed ion source of the present invention will be described below.

Figure 7:
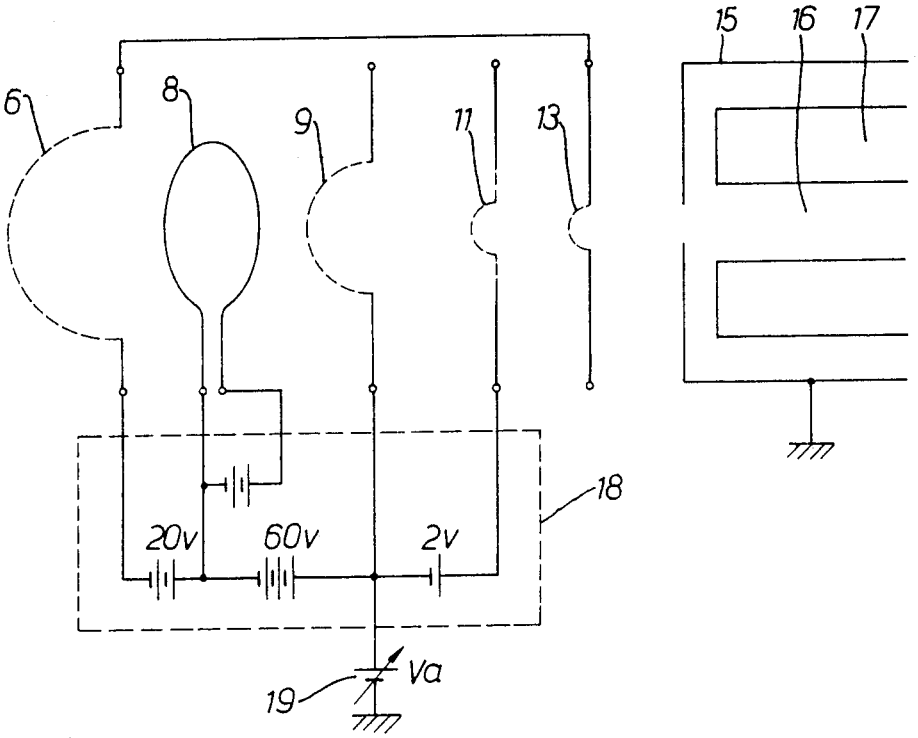
FIG. 7 is a schematic diagram of an ion source according to the present invention and a power-source circuit energizing the ion source.
Figure 8:
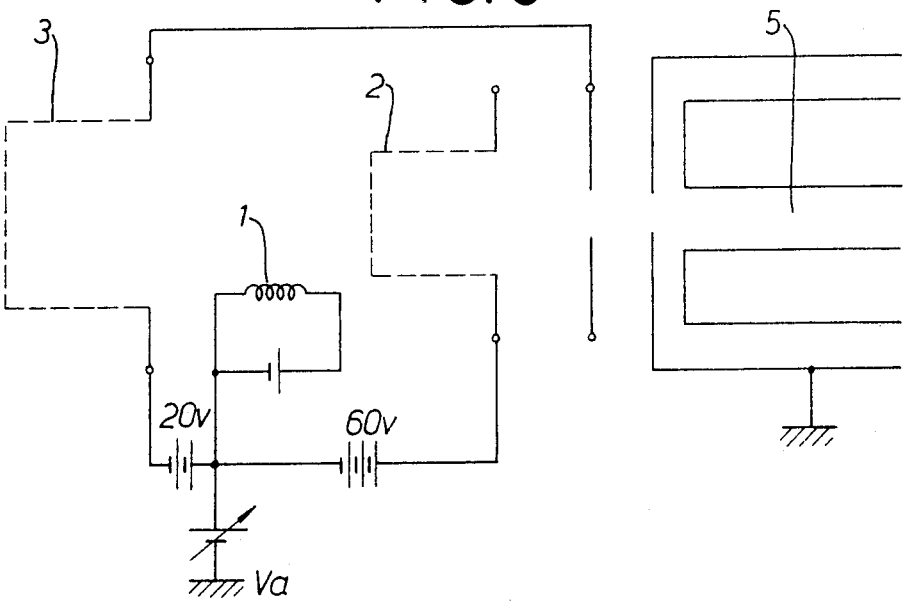
FIG. 8 is a circuit diagram of a power source energizing the conventional BA gauge type of ion source.
Figure 9:
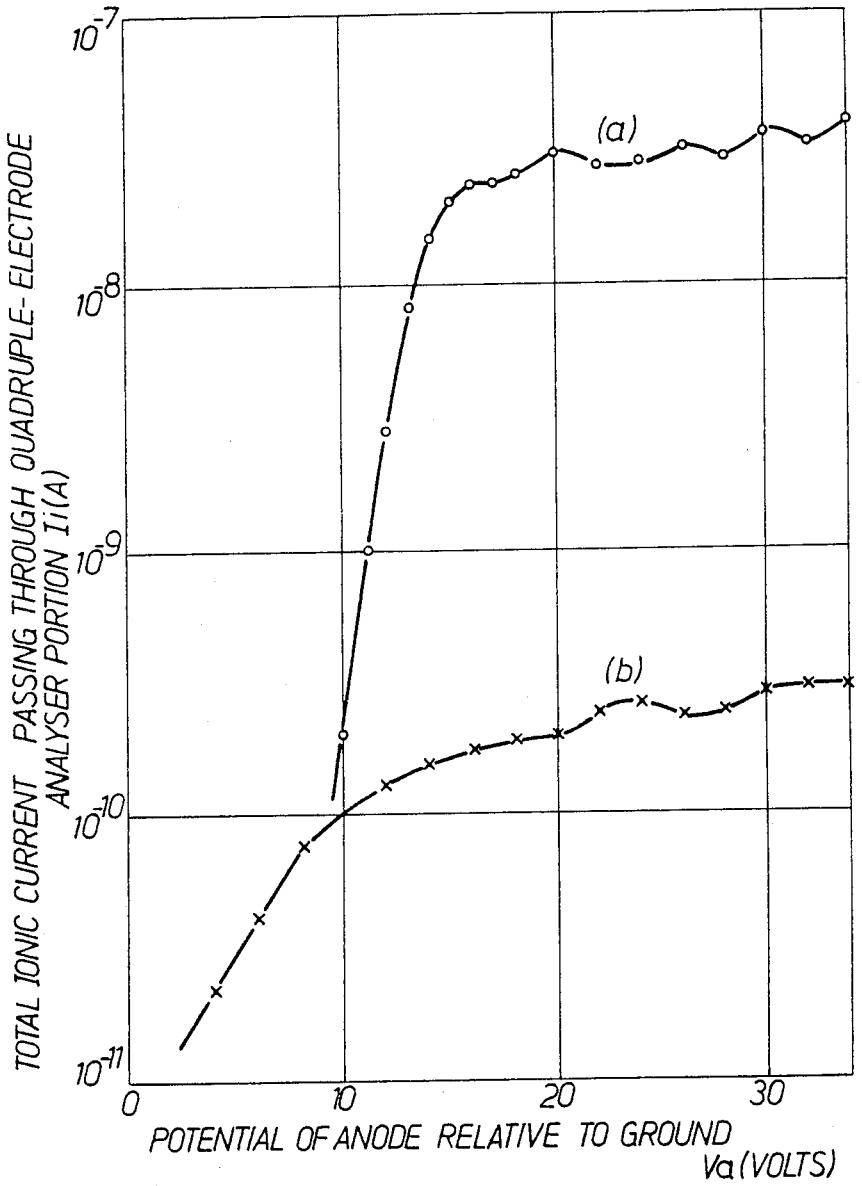
FIG. 9 is a graph of the characteristics of the conventional BA gauge type of ion source and the ion source of the present invention.

The ion source of the present invention is connected to a power source 18 which has a stabilized voltage, as shown in FIG. 7, and an automatic stabilizer circuit is provided to control a power source heating the hot-cathode filament 8, so that a constant electronic current is obtained. Under this state, the power source 18 for the entire ion source is floating, a voltage-variable power source 19 is connected to the first anode 9 to determine the energy of ions entering the quadruple-electrode analyzer portion at a potential above ground potential, and the electrical conditions of the quadruple-electrode analyzer portion are determined so that all the ions incident on the quadruple-electrode analyzer portion can be collected. The total ionic current Ii passing through the analyzer portion was found with respect to the potential Va of the first anode, under conditions in which the total voltage could be measured. The results were as shown by curve (a) in FIG. 9. It can be seen from the graph that the ionic current Ii starts to increase rapidly at $Va \approx 10$ volts, stops increasing at $Va \approx 16$ volts, and varies in a complicated manner above 16 volts. This indicates that most of the ions are concentrated between $10 \leqq Va < 16$. The ions within this range are generated between the first anode 9 and the second anode 11, and have a small energy bandwidth. When the potential Va is equal to or greater than 16 volts, the ions generated between the second anode 11 and the ion-extraction electrode 13 are introduced, and the curve changes in a complex manner, so that if the potential Va is set to 16 volts, only the ions generated between the first anode 9 and the second anode 11 are used, and the energy of the incident ions is distributed over a range of between 0 to 6 eV, making it possible to obtain a very high resolution. Curve (b) of FIG. 9 shows the total ionic current Ii passing through the analyzer portion, with respect to the anode potential Va, when a conventional BA gauge type of ion source is placed under the same electrical conditions as those for the ion source of the present invention, as shown in FIG. 8. In this case, although the absolute value of the ionic current is small, the energy of ions is distributed uniformly over a range of $Va=0$ to 50, clearly indicating a difference in sensitivity and resolution from those of the ion source of the present invention. The degree of vacuum during measurement was $P=2\times10^{-6}$ Torr, and the sensitivities found from the graph of FIG. 9 are shown in Table 1, when $Va=16$ volts. A comparison of the two indicates that the ion source of the present invention, which permits a large emission current to flow, exhibits a sensitivity that is about 130 times greater in terms of practical sensitivity, and a sensitivity that is about 55 times greater in terms of gauge sensitivity, compared with the conventional BA gauge type of ion source.

TABLE 1

| | Ion source of the present invention | Conventional ion source |
|---|---|---|
| Practical sensitivity (A. $Torr^{-1}$) | $1.15 \times 10^{-2}$ | $0.9 \times 10^{-4}$ |
| Gauge sensitivity ($Torr^{-1}$) | 2.9 | $4.5 \times 10^{-2}$ |
| Emission current (mA) | 4 | 2 |

The ion source of the present invention features a very high sensitivity and a small energy dispersion, because of the double-anode construction in which the anode is divided into a first anode and a second anode. That is, the electrons emitted from the hot-cathode filament 8 travel toward the ion-extraction electrode 13 through the second anode 11, attracted by the approximately hemispherical first anode 9. However, since the potential of the ion-extraction electrode 13 is set to a value lower than the potential of the hot-cathode filament 8, the electrons are repelled by the ion-extraction electrode 13. The repelled electrons are attracted by the second anode 11 and travel toward the shielding electrode 6 through the first anode 9. However, since the potential of the shielding electrode is also maintained at a value lower than the potential of the hot-cathode filament 8, the electrons are again repelled by the shielding electrode 6, so that the electrons oscillate repeatedly between the shielding electrode 6 and the ion-extraction electrode 13. These electrons are eventually captured by either the first anode 9 or the second anode 11, but this period, large quantities of ions are generated between the first anode 9 and the second anode 11. A potential difference of a few volts is applied between the first anode 9 and the second anode 11, so that the ions generated therebetween are attracted by the second anode 11, and the ions are collected thereby very efficiently. Since the potential difference between these two electrodes is only a few volts, the energy dispersion of the ions is confined to within a range of a few electron volts. Those of the ions converged by the second anode 11 that have passed through the wire gauze of the second anode 11 are accelerated by a potential difference of about 80 volts toward the convex lens-shaped wire gauze of the ion-extraction electrode 13, due to a lens effect provided by an electric field distribution which describes a gentle curve. Therefore, the convergence ratio of the ions can be greatly increased, making it possible to provide the ion source which is small in size but which has an ultrahigh sensitivity.

The present invention is described above with reference to the embodiment thereof shown in the drawings, but the invention should in no way be limited thereto. For instance, the ion source of the present invention is not limited to use in a quadruple-electrode mass analyzer alone, but can also be adapted to an ionization vacuum gauge, an ion gun, or the like.

EFFECTS OF THE INVENTION

As mentioned above, according to the electron-impact type of ion source of the present invention based upon a three-electrode construction consisting of an anode, a hot-cathode filament and an ion-extraction electrode, the anode is divided into two independent cage-like electrodes, a first anode and a second anode, composed of a grid or wire gauze that permits the passage of electrodes, the two anodes are so arranged that their central axes agrees, an annular hot-cathode filament is arranged around the outer periphery of the first anode, and an ion-extraction electrode is arranged at the open end of the second anode. Therefore, it is possible to obtain a highly-sensitive ion source which is small in size, which enables the easy removal of gases, and which permits the energy of ions to disperse only a little. Accordingly, residual gases can be analyzed under ultrahigh vacuum conditions of the order of $10^{-10}$ Torr, without the use of a secondary electron multiplier device. Thus it is possible to realize a quadruple-electrode mass analyzer which exhibits little change with time and which has a high reliability. The electron-impact type of ion source with a double grid anode of the present invention can therefore be employed for a mass analyzer which determines the kinds of molecules of residual gases or which determines the molecular densities in ultrahigh vacuum regions, in order to accomplish the desired objects and provide a high degree of technical and practical value.

What is claimed is:

1. In an electron-impact type of ion source of a three-electrode construction comprising at least a hot-cathode filament, an anode, and an ion-extraction electrode, an electron-impact type of ion source with a double grid anode characterized in that said anode is comprised of a first cage-like anode made of a metal grid or wire gauze that permits the passage of electrons and that has an open end, a second anode which also consists of a metal grid or wire gauze located at the open end side of said first anode, a hot-cathode filament arranged around the outer periphery of said first anode, and an ion-extraction electrode which faces said anode.

2. The electron-impact type of ion source with a double grid anode according to claim 1, wherein said double anode construction is realized by forming said first anode to an approximately hemispherical shape, and arranging the second anode virtually concentric therewith at the open end side of said first anode, said second anode being composed of a metal grid or wire gauze of an approximately hemispherical shape with a curvature smaller than that of said first anode.

* * * * *